US007911398B2

(12) United States Patent
Hsieh et al.

(10) Patent No.: US 7,911,398 B2
(45) Date of Patent: Mar. 22, 2011

(54) ANTENNA STRUCTURE AND WIRELESS COMMUNICATION APPARATUS THEREOF

(75) Inventors: Chih-Sen Hsieh, Taipei Hsien (TW); Hung-Yi Lin, Taipei Hsien (TW); Feng-Chi Eddie Tsai, Taipei Hsien (TW)

(73) Assignee: Wistron NeWeb Corporation, Hsi-Chih, Taipei Hsien (TW)

( * ) Notice: Subject to any disclaimer, the term of this patent is extended or adjusted under 35 U.S.C. 154(b) by 465 days.

(21) Appl. No.: 12/100,389

(22) Filed: Apr. 9, 2008

(65) Prior Publication Data

US 2009/0153415 A1 Jun. 18, 2009

(30) Foreign Application Priority Data

Dec. 14, 2007 (TW) ..... 96147807 A

(51) Int. Cl.
*H01Q 1/24* (2006.01)

(52) U.S. Cl. ..... 343/702; 343/700 MS

(58) Field of Classification Search ..... 343/702, 343/803, 804, 700 MS, 801
See application file for complete search history.

(56) References Cited

U.S. PATENT DOCUMENTS

| | | | | |
|---|---|---|---|---|
| 7,248,227 | B2 * | 7/2007 | Chen | 343/795 |
| 7,358,906 | B2 * | 4/2008 | Sato et al. | 343/702 |
| 2003/0189519 | A1 * | 10/2003 | Rutfors et al. | 343/702 |
| 2004/0056805 | A1 * | 3/2004 | Chen | 343/700 MS |
| 2004/0178957 | A1 * | 9/2004 | Chang et al. | 343/700 MS |
| 2006/0001579 | A1 * | 1/2006 | Noro et al. | 343/702 |
| 2006/0125697 | A1 * | 6/2006 | Hung et al. | 343/700 MS |

* cited by examiner

*Primary Examiner* — HoangAnh T Le
(74) *Attorney, Agent, or Firm* — Winston Hsu; Scott Margo

(57) ABSTRACT

An antenna structure includes a radiation element, a grounding element, and a feeding point. The radiation element includes a first section and a second section coupled to the first section. The grounding element includes a third section and a fourth section coupled to the third section. The third section is substantially parallel to the first section. The feeding point is coupled between the second section of the radiation element and the fourth section of the grounding element.

23 Claims, 11 Drawing Sheets

XZ Plane

YZ Plane

XY Plane

ANTENNA STRUCTURE AND WIRELESS COMMUNICATION APPARATUS THEREOF

BACKGROUND OF THE INVENTION

1. Field of the Invention

The present invention relates to an antenna structure and related wireless communication apparatus, and more particularly, to an antenna structure and related wireless communication apparatus further disposing a grounding element with an L shape to reduce coupling effects resulting from a metal plane with a large area.

2. Description of the Prior Art

As wireless telecommunication develops with the trend of micro-sized mobile communications products, the location and the space arranged for antennas become increasingly limited. Therefore, built-in micro antennas have been developed. Some micro antennas such as chip antennas and planar antennas, are commonly used and occupy very small volume.

The planar antenna has the advantages of small size, light weight, ease of manufacturing, low cost, high reliability, and can also be attached to the surface of any object. Therefore, micro-strip antennas and printed antennas are widely used in wireless communication systems. For example, monopole antennas or dipole antennas are suited for use in 3G transceivers. These antennas are widespread, being applied to GSM, DCS, UMTS, WLAN, Bluetooth, etc.

The housings of mobile communication products (for example, notebook computers) are now commonly constructed with metallic materials, such as Al—Mg alloys. However, a metal plane with a large area will affect the transmitting and receiving qualities of the monopole antenna, which makes the antennas difficult to match impedance to. Therefore, how to reduce sizes of the antennas, improve antenna efficiency, improve radiation patterns, and increase bandwidths of the antennas becomes important topics in this field.

SUMMARY OF THE INVENTION

It is one of the objectives of the present invention to provide an antenna structure and related wireless communication apparatus to solve the above-mentioned problems.

The present invention discloses an antenna structure. The antenna structure includes a radiation element, a grounding element, and a feeding point. The radiation element has a first section and a second section coupled to the first section. The grounding element has a third section and a fourth section coupled to the third section, wherein the third section is substantially parallel to the first section. The feeding point is coupled between the second section of the radiation element and the fourth section of the grounding element.

In one embodiment, the first section of the radiation element and the third section of the grounding element extend in an identical direction.

In one embodiment, the first section of the radiation element and the third section of the grounding element extend in different directions.

In one embodiment, a joint point of the third section and the fourth section of the grounding element forms a right angle, an oblique angle, or an arc angle.

The present invention discloses a wireless communication apparatus. The wireless communication apparatus includes a housing and an antenna structure. The antenna structure includes a radiation element, a grounding element, and a feeding point. The radiation element has a first section and a second section coupled to the first section. The grounding element has a third section and a fourth section coupled to the third section, wherein the third section is substantially parallel to the first section. The feeding point is coupled between the second section of the radiation element and the fourth section of the grounding element.

In one embodiment, the wireless communication apparatus is a notebook computer.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
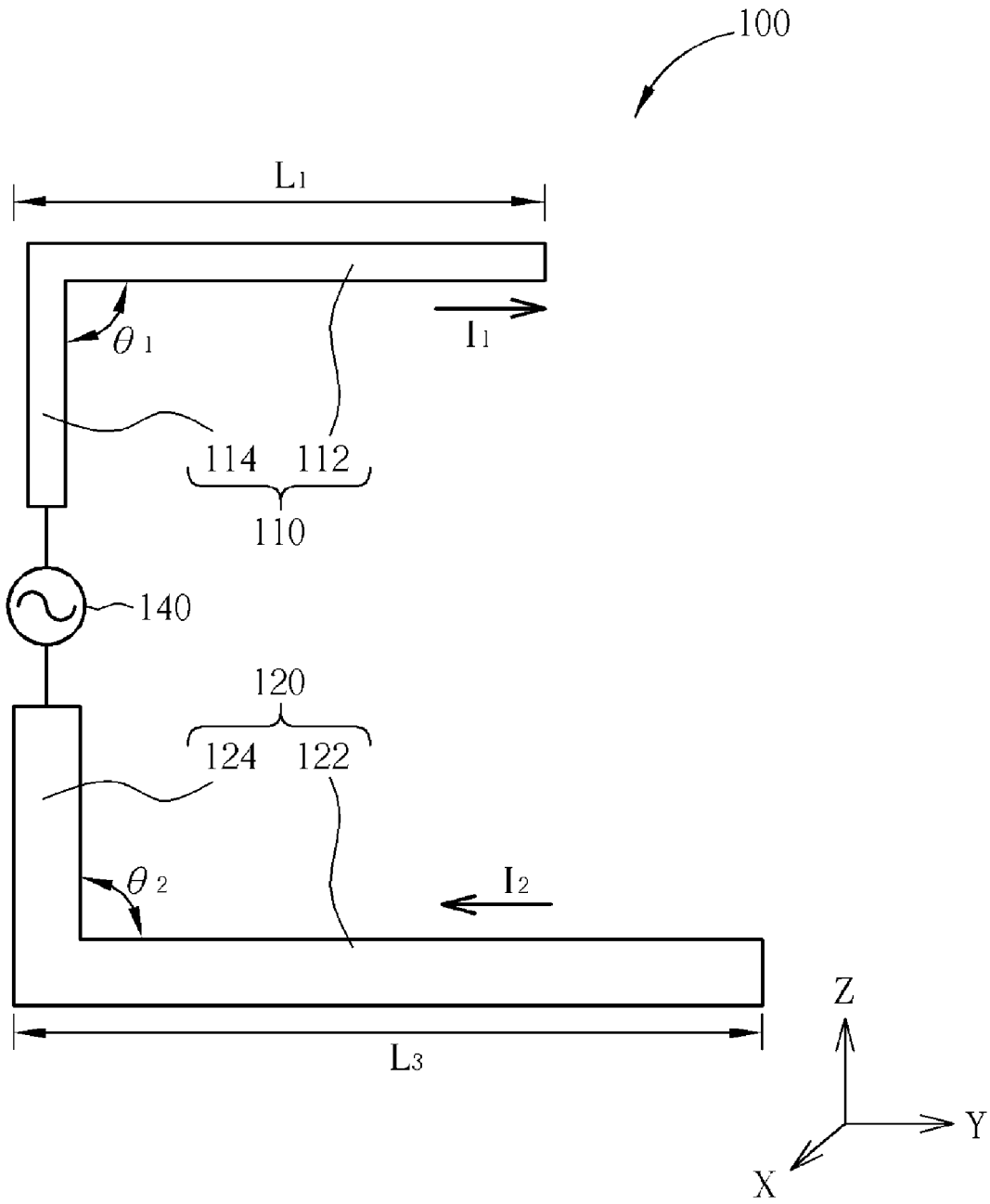
FIG. 1 is a diagram of an antenna structure according to a first embodiment of the present invention.

Please refer to FIG. 1. FIG. 1 is a diagram of an antenna structure 100 according to a first embodiment of the present invention. The antenna structure 100 includes a radiation element 110, a grounding element 120, and a feeding point 140. The radiation element 110 has a first section 112 and a second section 114 coupled to the first section 112. The first section 112 is not parallel to the second section 114, and there is an angle $\theta_1$ included between the first section 112 and the second section 114. The grounding element 120 has a third section 122 and a fourth section 124 coupled to the third section 122. The third section 122 is not parallel to the fourth section 124, and there is an angle $\theta_2$ included between the third section 122 and the fourth section 124. The third section 122 of the grounding element 120 is substantially parallel to the first section 112 of the radiation element 110. In addition, the feeding point 140 is coupled between the second section 114 of the radiation element 110 and the fourth section 124 of the grounding element 120.

Please keep referring to FIG. 1. The radiation element 100 assumes an L shape, wherein the first section 112 and the second section 114 are each slender rectangles and a current $I_1$ flows through the first section 112 in the direction of the arrow shown in FIG. 1. Similarly, the grounding element 120 has an L shape, wherein the third section 122 and the fourth section 124 are each slender rectangles and a current $I_2$ flows through the third section 122 in the direction of the arrow shown in FIG. 1. Because the third section 122 of the grounding element 120 is substantially parallel to the first section 112 of the radiation element 110, the direction of the current $I_2$ can be adjusted to be substantially parallel to the direction of current $I_1$. Therefore, an impedance matching and radiation patterns of the antenna structure 100 can be changed to achieve a goal of adjusting energy upward (i.e., +Z axis) without being affected by a nearby metal plane with a large area. The antenna structure 100 is usually disposed on a housing of a wireless communication apparatus (for example, a notebook computer). Assuming that the housing of the notebook computer is constructed of metallic material, such as Al—Mg alloy, the efficiency of the antenna structure 100 will be affected by the housing. The third section 122 of the grounding element 120 being designed as a slender rectangle in the present invention reduces the decrease in efficiency caused by the housing on the antenna structure 100. Furthermore, a length $L_3$ of the third section 122 of the grounding element 120 should be determined depending on the effect to the radiation element 110 caused from the housing. The length $L_3$ of the third section 122 of the grounding element 120 can be designed to be greater than a length $L_1$ of the first section 112 of the radiation element 110, which means $L_3>L_1$.

In this embodiment, the first section 112 of the radiation element 110 and the third section 122 of the grounding element 120 extend in an identical direction (i.e., the +Y axis shown in FIG. 1), but is not a limitation of the present invention. In addition, the radiation element 100 resonates at an operating frequency band of a 3G wireless communication system, for example, at the operating frequency band 1570 MHz-1580 MHz of GPS, but this is not a limitation of the present invention and can be applied to wireless communication systems of other types. The length $L_1$ is approximately one-fourth of a wavelength ($\lambda/4$) of a resonance mode generated by the antenna structure 100.

Please note that, as mentioned above, the radiation element 100 has an L shape and the first section 112 and the second section 114 are each a slender rectangle, but this is not a limitation of the present invention. Those skilled in the art should appreciate that various modifications of the radiation element 110 may be made. For example, the shape of the antenna structure 110 may be modified appropriately without departing the design spirit of the antenna structure disclosed in the present invention. Please also note that, the angles $\theta_1$ and $\theta_2$ are each a right angle (i.e., $\theta_1=\theta_2=90°$) in this embodiment. Of course, the antenna structure 100 shown in FIG. 1 is merely an embodiment of the present invention, and, as is well known by persons of ordinary skill in the art, suitable variations can be applied to the antenna structure 100. In the following, several embodiments illustrate various modifications of the antenna structure 100.

Figure 2:
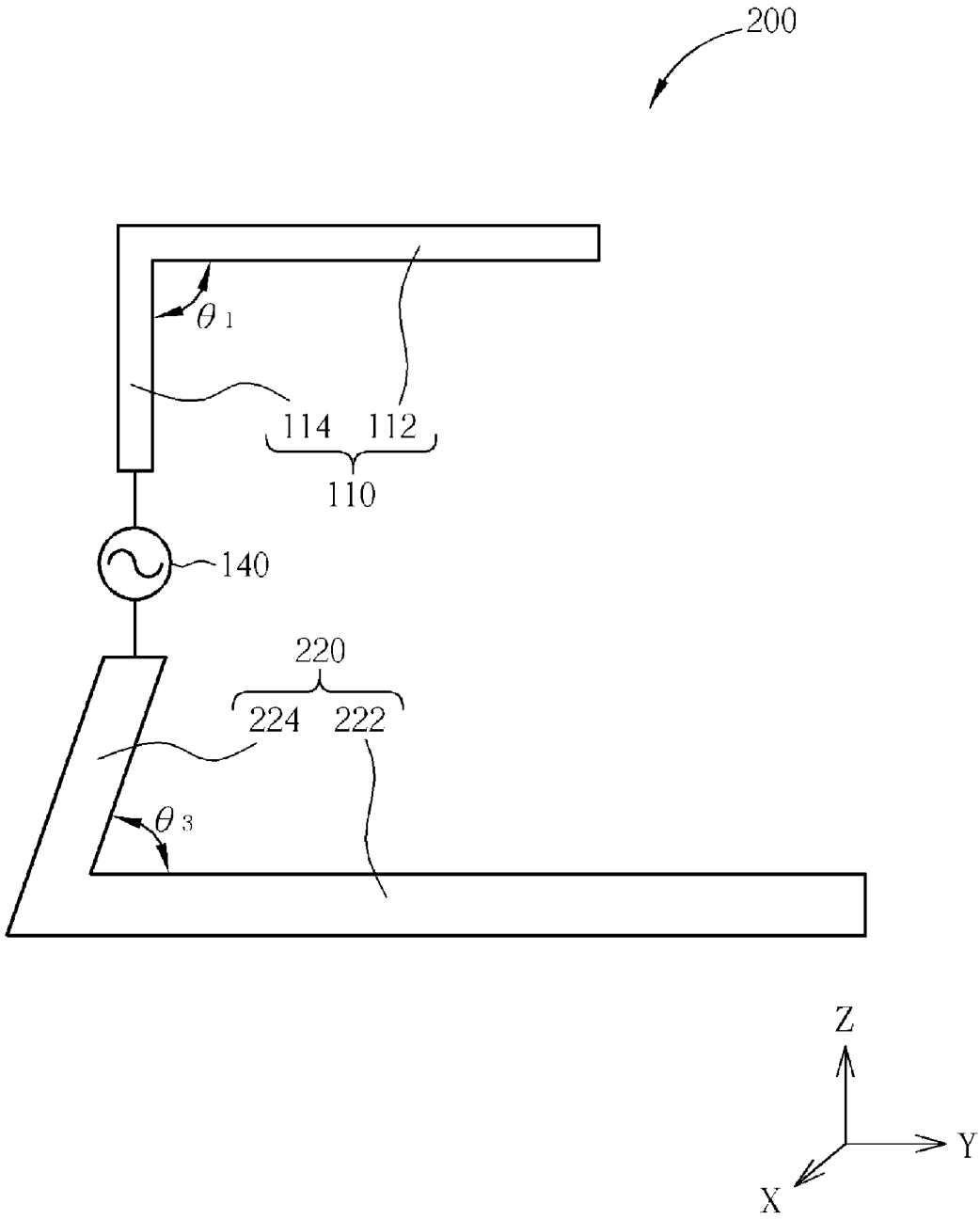
FIG. 2 is a diagram of an antenna structure according to a second embodiment of the present invention.

Please refer to FIG. 2. FIG. 2 is a diagram of an antenna structure 200 according to a second embodiment of the present invention, which is a varied embodiment of the antenna structure 100 shown in FIG. 1. In FIG. 2, the architecture of the antenna structure 200 is similar to that of the antenna structure 100, and the difference between them is that a joint point of a third section 222 and a fourth section 224 of a grounding element 220 included by antenna structure 200 forms an oblique angle; that is, the angle $\theta_3$ is not 90° (in this embodiment, $\theta_3<90°$).

Figure 3:
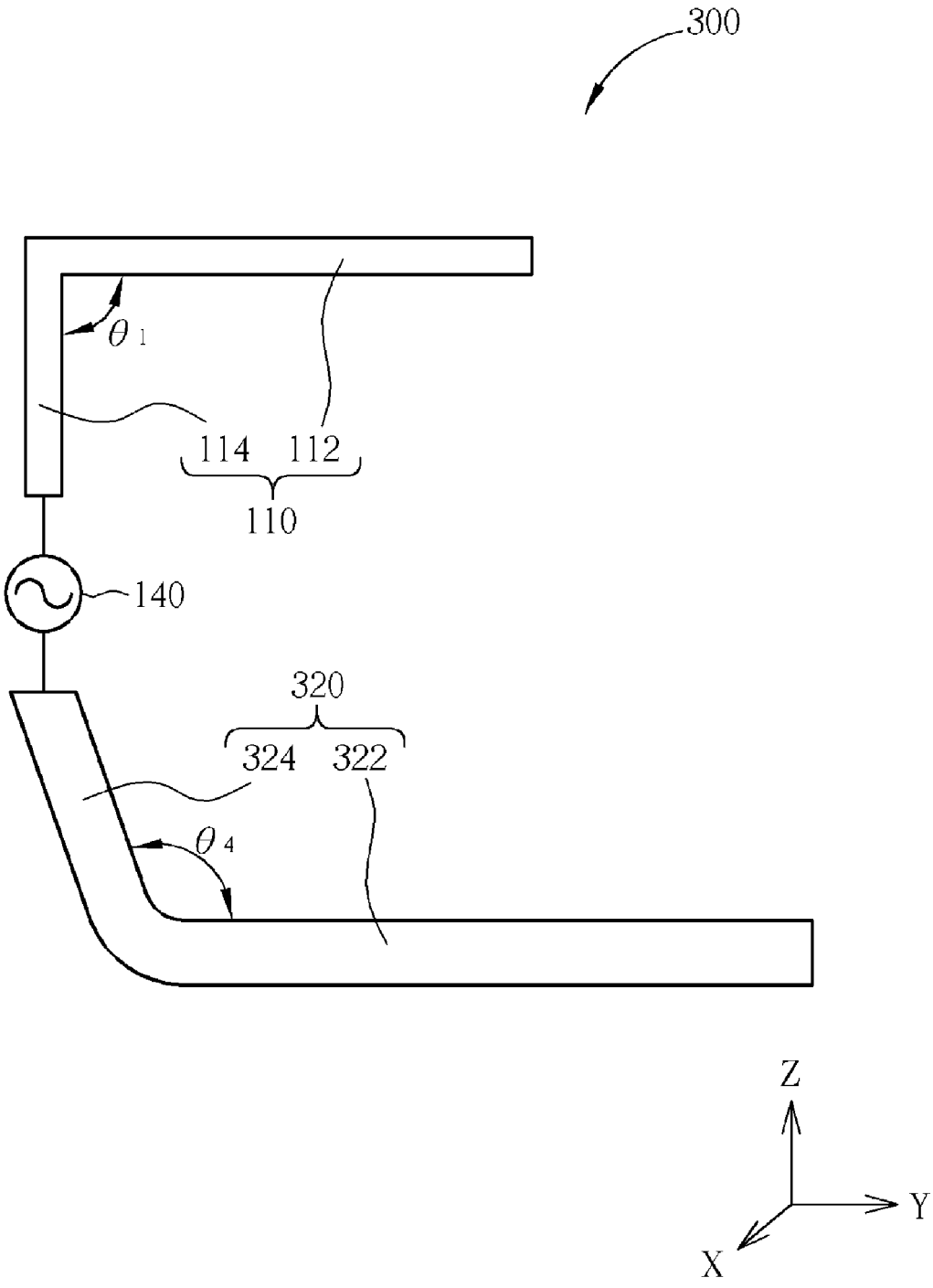
FIG. 3 is a diagram of an antenna structure according to a third embodiment of the present invention.

Please refer to FIG. 3. FIG. 3 is a diagram of an antenna structure 300 according to a third embodiment of the present invention, which is a varied embodiment of the antenna structure 100 shown in FIG. 1. In FIG. 3, the architecture of the antenna structure 300 is similar to that of the antenna structure 100, the difference between them being that a joint point of a third section 322 and a fourth section 324 of a grounding element 320 included by antenna structure 300 forms an arc. In other words, the angle $\theta_4$ is an arc angle.

Figure 4:
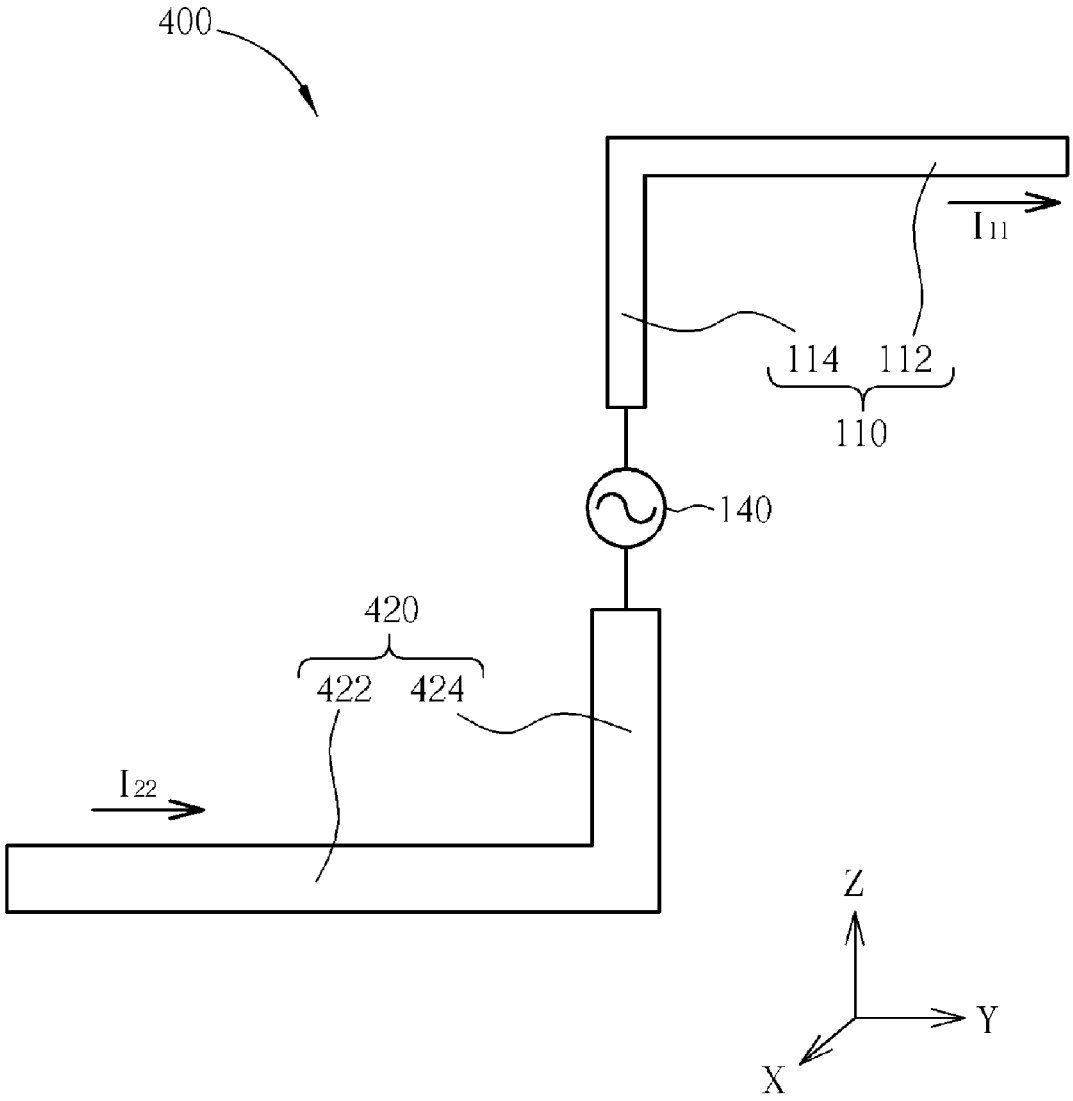
FIG. 4 is a diagram of an antenna structure according to a fourth embodiment of the present invention.

Please refer to FIG. 4. FIG. 4 is a diagram of an antenna structure 400 according to a fourth embodiment of the present invention. In FIG. 4, the architecture of the antenna structure 400 is also similar to that of the antenna structure 100. The difference between them is that a third section 422 of a grounding element 420 and the first section 112 of the radiation element 110 included by the antenna structure 400 extend in different directions. The third section 422 of the grounding element 420 extends in the −Y direction of the Y axis, and the first section 112 of the radiation element 110 extends in the +Y direction. In addition, a current $I_{11}$ of the radiation element 110 flowing through the first section 112 and a current $I_{22}$ of the grounding element 420 flowing through the third section 422 are represented by the arrows shown in FIG. 4. As can be seen from FIG. 4, because the third section 422 of the grounding element 420 is substantially parallel to the first section 112 of the radiation element 110, the directions of the currents $I_{11}$ and $I_{22}$ are substantially parallel to each other.

Figure 5:
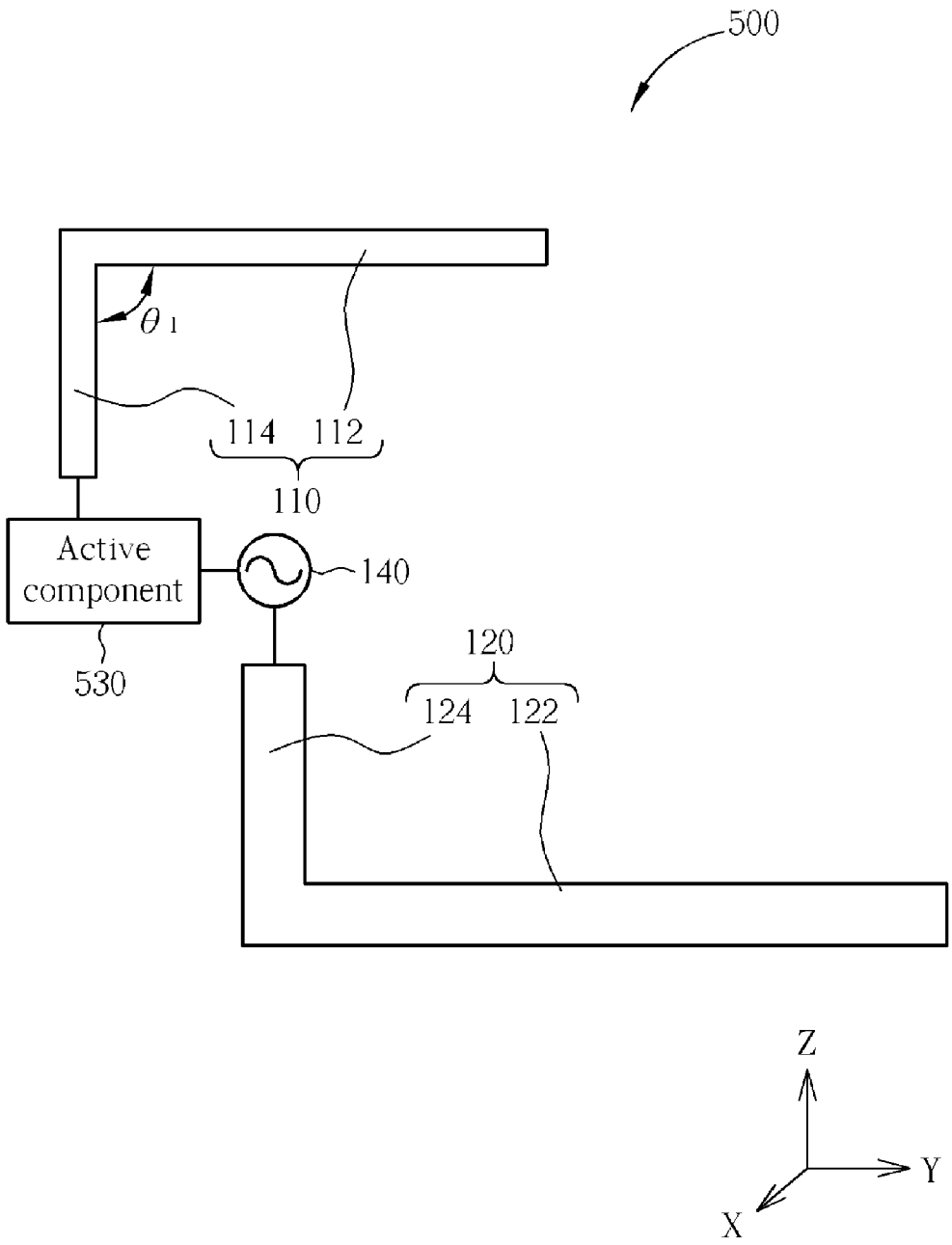
FIG. 5 is a diagram of an antenna structure according to a fifth embodiment of the present invention.

Please refer to FIG. 5. FIG. 5 is a diagram of an antenna structure 500 according to a fifth embodiment of the present invention. In FIG. 5, the architecture of the antenna structure 500 is similar to that of antenna structure 100, but the antenna structure 500 further includes an active component 530 disposed between the second section 114 of the radiation element 110 and the feeding point 140. In one embodiment, the active component 530 can be a low-noise amplifier (LNA) or a matching circuit, but is not meant as a limitation of the present invention. Those skilled in the art should appreciate that active components of other types can also be disposed between the second section 114 of the radiation element 110 and the feeding point 140 without departing from the spirit of the present invention, which should also belong to the scope of the present invention.

Those skilled in the art should appreciate that various modifications of the antenna structures in FIG. 1-FIG. 5 may be made without departing from the spirit of the present invention. For example, the antenna structures in FIG. 1-FIG. 5 can be arranged or combined randomly into a new varied embodiment. The abovementioned embodiments are presented merely for illustrating practicable designs of the present invention, and should not be limitations of the present invention.

Figure 6:
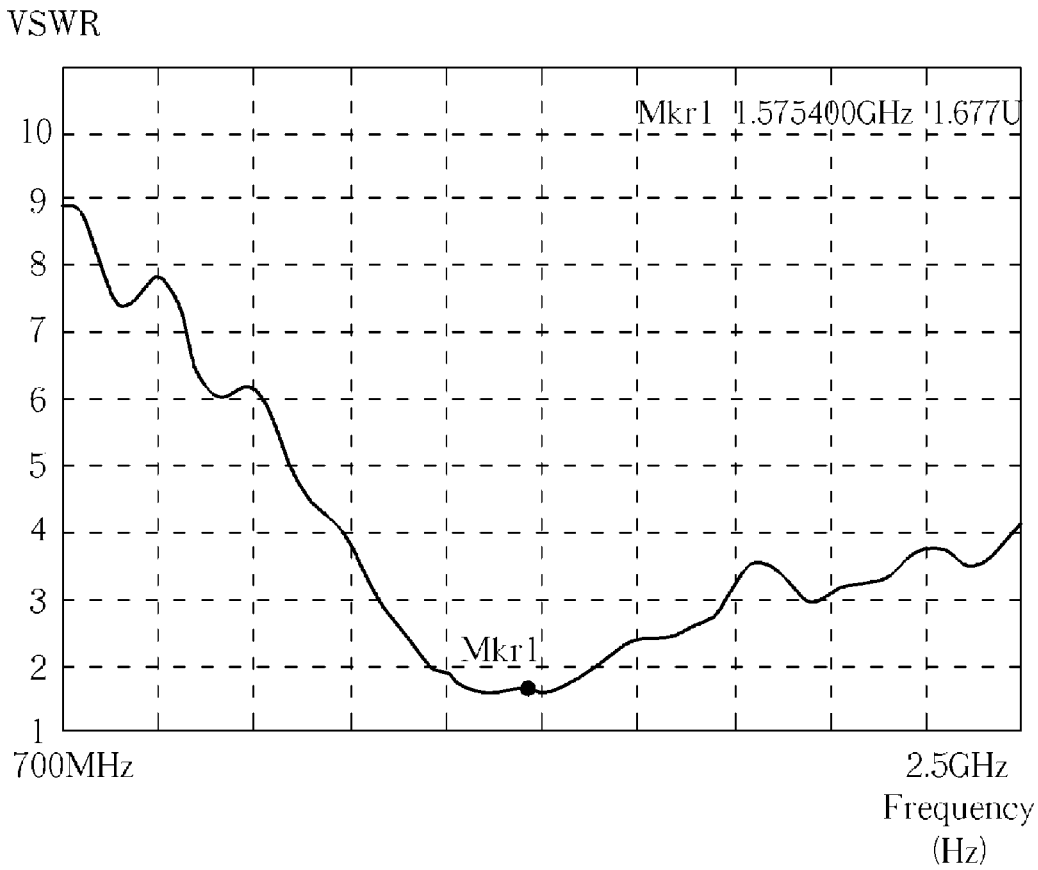
FIG. 6 is a diagram illustrating the VSWR of the antenna structure shown in FIG. 1.
Figure 7:
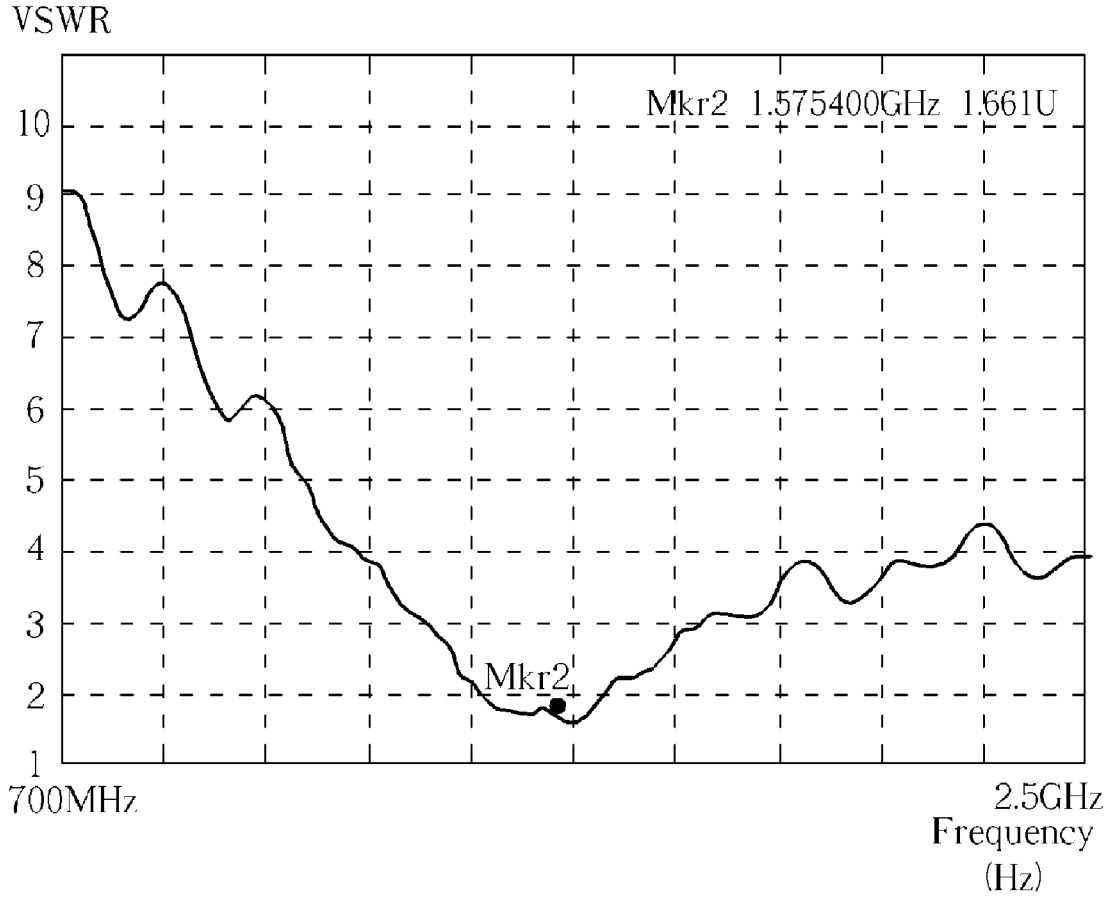
FIG. 7 is a diagram illustrating the VSWR of the antenna structure shown in FIG. 4.

Please refer to FIG. 6 to FIG. 7. FIG. 6 is a diagram illustrating the VSWR of the antenna structure shown in FIG. 1, and FIG. 7 is a diagram illustrating the VSWR of the antenna structure shown in FIG. 4. The horizontal axis represents frequency (Hz), between 700 MHz and 2.5 GHz, and the vertical axis represents the VSWR. As shown in FIG. 6, the frequency 1.575 GHz and the VSWR 1.677 of a sign Mkr_1 are marked. As shown in FIG. 7, the frequency 1.575 GHz and the VSWR 1.671 of a sign Mkr_2 are marked. As is known from FIG. 6 and FIG. 7, the VSWR falls below 2 for frequencies adjacent to 1570-1580 MHz, which can satisfy demands of the wireless communication system (for example, the GPS application). In other words, regardless of whether the first section of the radiation element and the third section of the grounding element extend in the same direction, all belong to the scope of the present invention.

Figure 8:
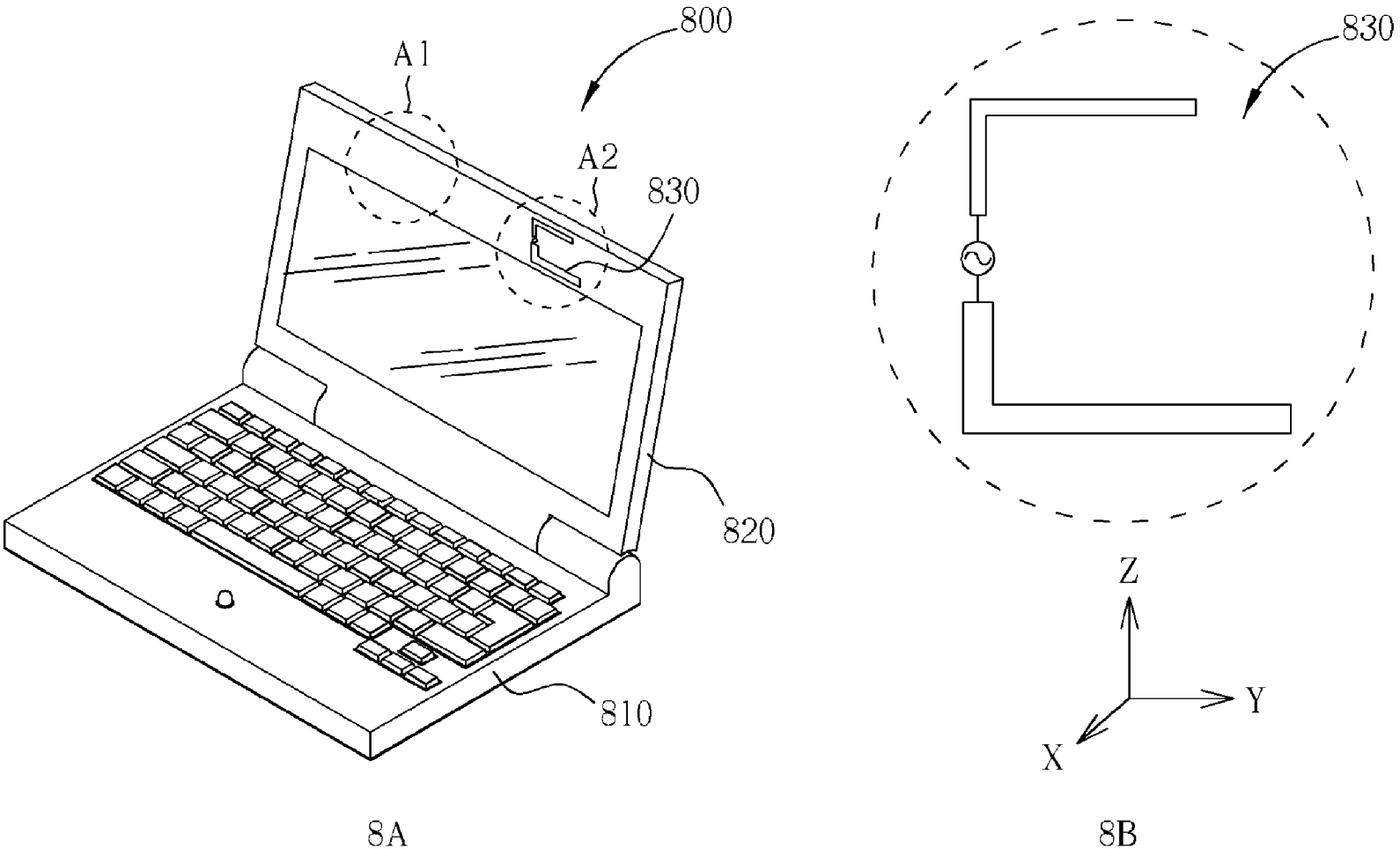
FIG. 8 is a diagram of a wireless communication apparatus according to an embodiment of the present invention.

Please refer to FIG. 8. FIG. 8 is a diagram of a wireless communication apparatus 800 according to an embodiment of the present invention. In this embodiment, the wireless communication apparatus 800 is a notebook computer, but is not a limitation of the present invention and can be a wireless communication apparatus of other types. As shown in 8A, the wireless communication apparatus 800 includes a housing 810 and an antenna 830, wherein the antenna 830 is disposed inside the housing 810 and is parallel to a first plane 820 of the housing 810. When a user starts using the wireless communication apparatus 800, the first plane 820 of the housing 810 is located at a Y-Z plane and the antenna 830 is disposed on locations A1 or A2 of the first plane 820. The housing 810 is constructed of a conductive material, such as an Al—Mg alloy, but is not limited to this only. As shown in 8B, the antenna 830 can be implemented by the antenna structure 100 shown in FIG. 1. Of course, the antenna 830 can also be implemented by changed forms of the antenna structure 100, such as the antenna structures 200-500 or any combinations of them in FIG. 2-FIG. 5.

Please note that when the user starts using the wireless communication apparatus 800, the first plane 820 of the housing 810 and the antenna 830 are located on the Y-Z plane. As can be seen from the antenna structure 100 in FIG. 1, because the third section 122 of the grounding element 120 is substantially parallel to the first section 112 of the radiation element 110, the direction of the current $I_2$ can be adjusted to be substantially parallel to the direction of the current $I_1$. Thus, the impedance matching and radiation patterns of the antenna structure can be changed to center the radiation patterns and energy of the antenna 830 onto the +Z axis.

Figure 9:
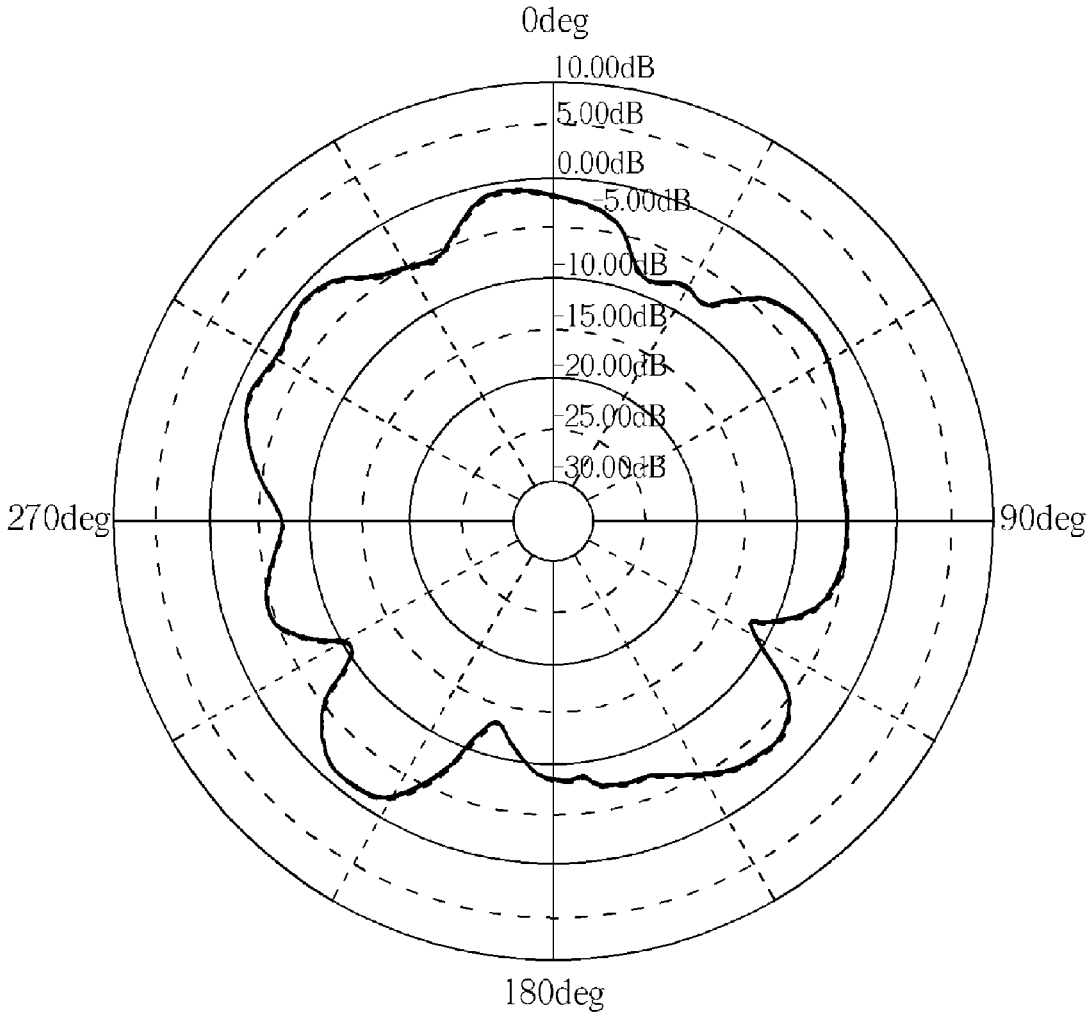
FIG. 9 is a diagram illustrating a first radiation pattern of the antenna of the wireless communication apparatus in FIG. 8.
Figure 10:
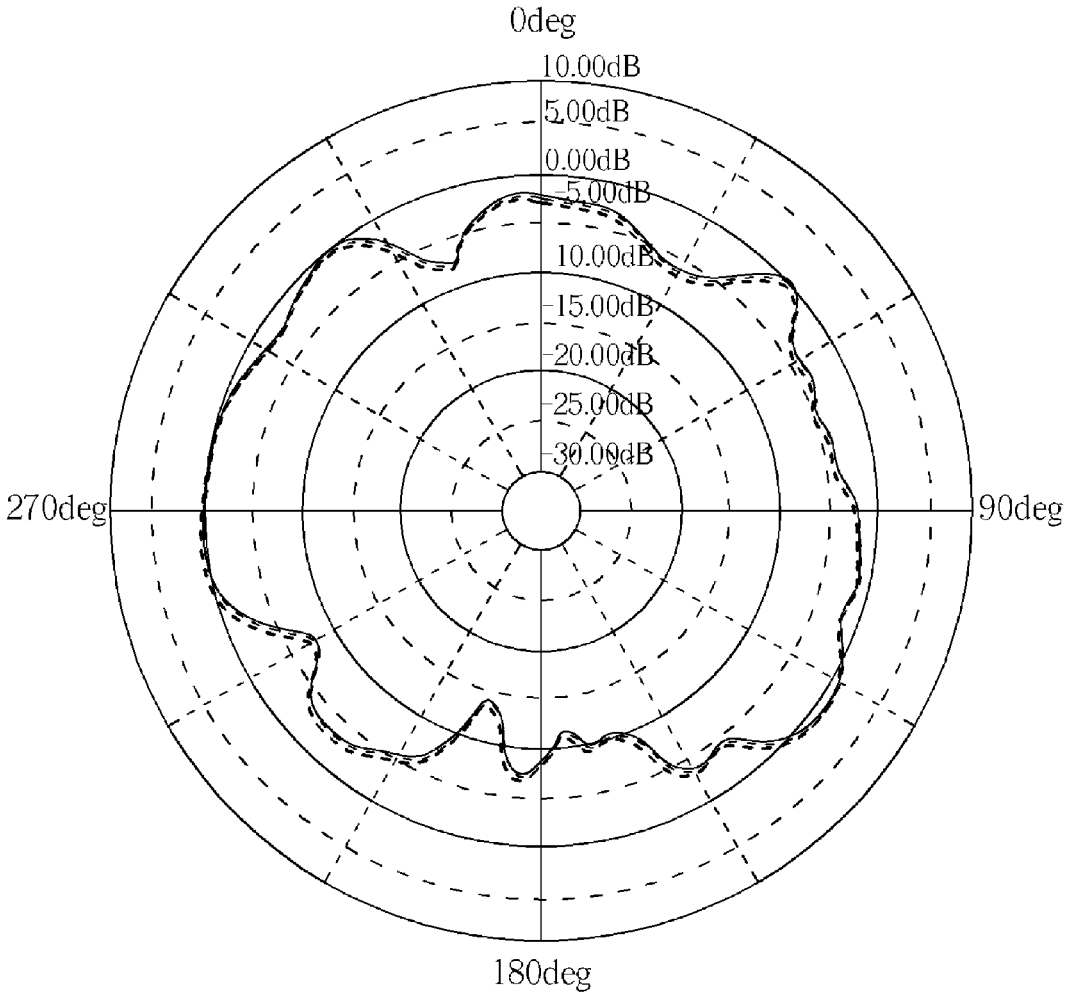
FIG. 10 is a diagram illustrating a second radiation pattern of the antenna of the wireless communication apparatus in FIG. 8.
Figure 11:
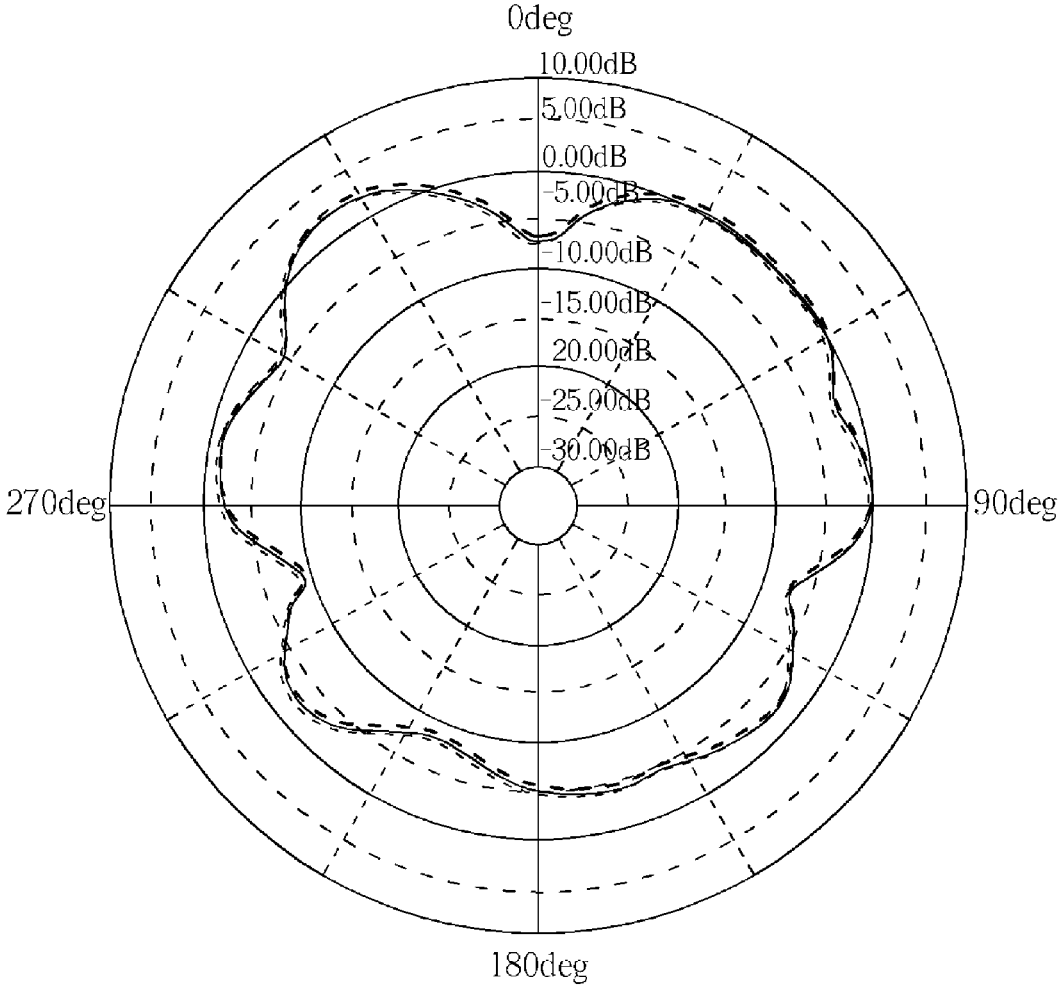
FIG. 11 is a diagram illustrating a third radiation pattern of the antenna of the wireless communication apparatus in FIG. 8.

Please refer to FIG. 9-FIG. 11. FIG. 9-FIG. 11 are each a diagram illustrating a radiation pattern of the antenna 830 of the wireless communication apparatus 800 in FIG. 8. FIG. 9 shows measurement results of the antenna 830 in XZ plane. FIG. 10 shows measurement results of the antenna 830 in YZ plane. FIG. 11 shows measurement results of the antenna 830 in XY plane. As can be seen, although the antenna 830 is disposed on the first plane 820 of the housing 810 constructed of a metallic material, the radiation patterns and the efficiency of the antenna 830 are not affected by the material of the housing 810.

In addition, let's compare the antenna structure disclosed in the present invention with a conventional monopole antenna to further expand advantages of the antenna structure disclosed in the present invention. The conventional monopole antenna mentioned herein means an antenna having a single radiation object and a grounding plane with a large area: for example, a combination formed by the radiation element 110, the feeding point 140, and a grounding plane with a large area. That is, a grounding plane with a large area is used for replacing the grounding element 120. Let's now assume that the antenna structure disclosed in the present invention and the conventional monopole antenna are both disposed at the locations A1 or A2 of the wireless communication apparatus 800. The signal-to-noise ratio (C/No) of the antenna structure disclosed in the present invention is 46, and the C/No of the conventional monopole antenna is 42. As can be seen, inside the wireless communication apparatus 800 such as the notebook computer, the coupling effect caused from the housing 810 will seriously affect the conventional monopole antenna, for which it is hard to match impedance. However, the antenna structure in the present invention can substantially reduce such an effect.

From the above descriptions, the present invention provides the antenna structures 100-500 and related wireless communication apparatus 800. Through additionally disposing the grounding element with an L shape, the direction of the current $I_2$ can be adjusted and the coupling effect of the metal plane with a large area can be reduced. As can be seen from FIG. 1 and FIG. 8, when the user starts using the wireless communication apparatus 800, the first plane 820 of the housing 810 is located on the Y-Z plane and the antenna structure 830, implemented by the antenna structure 100, is also located on the Y-Z plane. At this time, the impedance matching and radiation patterns of the antenna structure can be changed by the third section 122 of the grounding element 120, therefore achieving the goal of adjusting energy upward (i.e., +Z axis) without being affected by the metal plane with a large area. Compared with the conventional monopole antenna, the radiation patterns of the antenna structures disclosed in the present invention can be centered upwards and have better C/No values. Hence, the antenna structures disclosed in the present invention are suitably applied to wireless communication systems like GPS.

Those skilled in the art will readily observe that numerous modifications and alterations of the device and method may be made while retaining the teachings of the invention.

What is claimed is:

1. An antenna structure, comprising:

a radiation element, having a first section and a second section coupled to the first section, wherein a length of the first section of the radiation element is one-fourth of a wavelength (λ/4) of a resonance mode generated by the antenna structure;

a grounding element, having a third section and a fourth section coupled to the third section, the third section being substantially parallel to the first section, wherein at least one of the radiation element and the grounding element essentially comprises two straight sections, and the two straight sections comprise the first section as well as the second section, or the two straight sections comprise the third section as well as the fourth section; and a feeding point, coupled between the second section of the radiation element and the fourth section of the grounding element.

2. The antenna structure of claim 1, wherein a length of the third section of the grounding element is greater than a length of the first section of the radiation element.

3. The antenna structure of claim 2, wherein the first section of the radiation element and the third section of the grounding element extend in an identical direction.

4. The antenna structure of claim 2, wherein the first section of the radiation element and the third section of the grounding element extend in different directions.

5. The antenna structure of claim 2, wherein a joint point of the third section and the fourth section of the grounding element forms a right angle.

6. The antenna structure of claim 1, further comprising an active component disposed between the second section of the radiation element and the feeding point.

7. The antenna structure of claim 6, wherein the active component is a low-noise amplifier (LNA).

8. An antenna structure, comprising:

a radiation element, forming an L shape, having a first section and a second section coupled to the first section, wherein a length of the first section of the radiation element is one-fourth of a wavelength (λ/4) of a resonance mode generated by the antenna structure;

a grounding element, forming an L shape, having a third section and a fourth section coupled to the third section, wherein at least one of the radiation element and the grounding element essentially comprises two straight sections, and the two straight sections comprise the first section as well as the second section, or the two straight sections comprise the third section as well as the fourth section; and a feeding point, coupled between the second section of the radiation element and the fourth section of the grounding element.

9. The antenna structure of claim 8, wherein there is a first current flowing through the first section and a second current flowing through the third section, and a direction of the first current is opposite to a direction of the second current.

10. The antenna structure of claim 9, wherein the first section of the radiation element and the third section of the grounding element extend in an identical direction.

11. The antenna structure of claim 8, wherein there is a first current flowing through the first section and a second current flowing through the third section, and a direction of the first current is the same as a direction of the second current.

12. The antenna structure of claim 11, wherein the first section of the radiation element and the third section of the grounding element extend in different directions.

13. The antenna structure of claim 8, wherein a length of the third section of the grounding element is greater than a length of the first section of the radiation element, and the third section is substantially parallel to the first section.

14. The antenna structure of claim 8, further comprising an active component disposed between the second section of the radiation element and the feeding point.

15. A wireless communication apparatus, comprising:

a housing; and an antenna structure, disposed inside the housing and parallel to a first plane of the housing, the antenna structure comprising:

a radiation element, having a first section and a second section coupled to the first section, wherein a length of the first section of the radiation element is one-fourth of a wavelength ($\lambda/4$) of a resonance mode generated by the antenna structure;

a grounding element, having a third section and a fourth section coupled to the third section, the third section being substantially parallel to the first section, wherein at least one of the radiation element and the grounding element essentially comprises two straight sections, and the two straight sections comprise the first section as well as the second section, or the two straight sections comprise the third section as well as the fourth section; and a feeding point, coupled between the second section of the radiation element and the fourth section of the grounding element.

16. The wireless communication apparatus of claim 15, wherein the first section of the radiation element and the third section of the grounding element extend in an identical direction.

17. The wireless communication apparatus of claim 15, wherein the first section of the radiation element and the third section of the grounding element extend in different directions.

18. The wireless communication apparatus of claim 15, wherein a length of the third section of the grounding element is greater than a length of the first section of the radiation element.

19. The wireless communication apparatus of claim 15, wherein a joint point of the third section and the fourth section of the grounding element forms a right angle.

20. The wireless communication apparatus of claim 15, further comprising an active component disposed between the second section of the radiation element and the feeding point.

21. The antenna structure of claim 1, wherein a joint point of the third section and the fourth section of the grounding element forms an oblique angle or an arc angle.

22. The antenna structure of claim 8, wherein a joint point of the third section and the fourth section of the grounding element forms an oblique angle or an arc angle.

23. The wireless communication apparatus of claim 15, wherein a joint point of the third section and the fourth section of the grounding element forms an oblique angle or an arc angle.

* * * * *